US006614459B2

(12) United States Patent
Fujimoto et al.

(10) Patent No.: US 6,614,459 B2
(45) Date of Patent: Sep. 2, 2003

(54) THERMAL PRINTER CAPABLE OF PERFORMING ERROR DIFFUSION

(75) Inventors: Hisayoshi Fujimoto, Kyoto (JP); Hiroaki Onishi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/068,442

(22) Filed: Feb. 5, 2002

(65) Prior Publication Data

US 2002/0105573 A1 Aug. 8, 2002

(30) Foreign Application Priority Data

Feb. 5, 2001 (JP) ..... 2001-027937

(51) Int. Cl.[7] ..... B41J 2/52; B41J 2/205
(52) U.S. Cl. ..... 347/183
(58) Field of Search ..... 347/15, 183; 358/301, 358/3.03; 400/120.07

(56) References Cited

U.S. PATENT DOCUMENTS 4,768,042 A * 8/1988 Zama ..... 358/298
5,565,904 A * 10/1996 Sawano ..... 347/183
5,760,813 A 6/1998 Yamaguchi et al.
6,402,281 B1 * 6/2002 Nakahara et al. ..... 347/15
2002/0067519 A1 * 6/2002 Suzuki et al. ..... 358/519

FOREIGN PATENT DOCUMENTS

JP 59-76269 * 5/1984 ..... 347/183
JP 59-191967 10/1984
JP 3286680 * 12/1991 ..... H04N/1/40
JP 4-284267 * 10/1992 ..... 347/183
JP 5-056263 * 3/1993 ..... H04N/1/40
JP 2001-315319 * 11/2001 ..... B41J/2/52

* cited by examiner

*Primary Examiner*—Huan Tran
(74) *Attorney, Agent, or Firm*—Merchant & Gould P.C.

(57) ABSTRACT

A thermal printer includes a thermal printhead, a transfer assembly, and a controller. The thermal printhead has an array of heating regions arranged in a primary scanning direction, and a driver for selectively heating the heating regions. The transfer assembly feeds a recording paper in facing relationship to the array of heating regions in a secondary scanning direction perpendicular to the primary scanning direction. The controller is combined with the driver for causing each of the heating regions to selectively form, on the recording paper, differently sized print dots which include an off-dot, a maximum-size dot, and at least one intermediate-size dot.

8 Claims, 6 Drawing Sheets

THERMAL PRINTER CAPABLE OF PERFORMING ERROR DIFFUSION

BACKGROUND OF THE INVENTION

1. Field of the Invention

The present invention relates to a technique for enhancing the quality of an image printed by a thermal printhead utilizing error diffusion.

2. Description of the Related Art

As is well known, a thermal printer is provided with a thermal printhead which includes an array of heating regions extending in the primary scanning direction. By selectively heating the heating regions, a desired image can be printed on a recording paper thermosensitively or by thermal transfer using an ink ribbon. As compared with an ink jet printer, such a thermal printer may be advantageous in that the printhead is smaller in size and weight while providing easier maintenance.

On the other hand, as a method for pseudo-half tone processing, dithering is increasingly replaced by error diffusion. The dithering process is one of the area gradation methods. In this method, for a given area including a matrix of print dots, the ratio of on-dots (black dots for example) to off-dots (white dots for example) is adjusted to change the shades in the image. In the dithering, however, one print dot corresponds to one pixel of the image. Therefore, a large number of "off-pixels" may be produced, which may degrade the resolution. The error diffusion, the details of which will be described later, can solve the above-described problem to enhance the image quality more effectively than the dithering process.

The error diffusion is conventionally utilized also for a thermal printer. However, unlike the multi-value error diffusion utilized for an ink jet printer, the error diffusion conventionally utilized for a thermal printer is two-value error diffusion. Specifically, in a conventional thermal printer utilizing the error diffusion, one print dot corresponds to one pixel, and only two print output levels (1 and 0 representing black or white for example) are utilized for the error diffusion.

Specifically, the two-value error diffusion may be performed as follows. First, the half tone value of a first pixel under control is compared with a predetermined threshold value to determine whether the pixel should be made black or white. If the first pixel is determined as white, the tone of the first pixel becomes brighter than the actual tone of the print data. Such a difference (error) from the threshold value is reflected in making the black or while choice for a next pixel so that the next pixel is more likely to be determined as black. In this way, an error generated in the determination of one pixel is "diffused" to a next pixel on the same line or a next line for making the black or white determination for the next pixel. By repeating these process steps one after another, the errors become negligible when the pixels in a certain area are totally viewed.

As described above, a conventional thermal printer utilizes the two-value error diffusion. Generally speaking, however, half tone representation of an image becomes more sophisticated as the number of values utilized for the error diffusion increases. In this regard, the conventional thermal printer has room for improvement for enhancing the print image quality.

SUMMARY OF THE INVENTION

It is therefore an object of the present invention to provide a thermal printer capable of performing error diffusion utilizing three or more values for obtaining a high quality print image.

According to a first aspect of the present invention, there is provided a thermal printer comprises a thermal printhead, a transfer assembly, and a controller. The thermal printhead includes a row of heating regions arranged in a primary scanning direction, and a driver for selectively heating the heating regions. The transfer assembly feeds a recording paper in facing relationship to the row of heating regions of the printhead in a secondary scanning direction perpendicular to the primary scanning direction. The controller is combined with the driver for causing each of the heating regions to selectively form, on the recording paper, differently sized print dots which include an off-dot, a maximum-size dot, and at least one intermediate-size dot.

Preferably, the controller combined with the driver causes each of the heating regions to selectively form different intermediate-size print dots in addition to the off-dot and the maximum-size dot.

According to a preferred embodiment, the controller combined with the driver controls printing on a pixel-by-pixel basis. Each pixel comprises a matrix of print dots which includes at least two rows of print dots located adjacent to each other in the secondary scanning direction. Each row of print dots includes two print dots located adjacent to each other in the primary scanning direction.

Preferably, the controller combined with the driver is capable of printing each pixel in different output levels which include a lowest output level wherein all print dots in the matrix are the off-dots, a highest output level wherein all print dots in the matrix are the maximum-size dots, a first intermediate output level wherein the two dots in one row of the matrix are intermediate-size dots which are equally sized, and a second intermediate output level wherein the two dots in one row of the matrix are the maximum-size dots while the two print dots in another row of the matrix are intermediate-size dots which are equally sized.

Preferably, the recording paper is transferred in the secondary scanning direction by a pitch which is generally equal to a center-to-center distance between the two print dots in each row of the matrix.

Preferably, each of the heating regions has a width in the secondary scanning direction which is smaller than a total width of two adjacent heating regions in the primary scanning direction.

Preferably, the controller combined with the driver causes each of the heating regions to selectively form the different intermediate-size print dots and the maximum-size print dot by selectively supplying pulses of different widths to each of the heating regions.

The thermal printer may further comprise a thermal transfer ink ribbon fed between the printhead and the recording paper.

Other features and advantages of the present invention will become clearer from the detailed description given below with reference to the accompanying drawings.

DETAILED DESCRIPTION OF THE PREFERRED EMBODIMENT

A preferred embodiment of the present invention will be described below in detail with reference to the accompanying drawings. In this embodiment, the monochromatic printing is exemplarily described for easier description.

Figure 1:
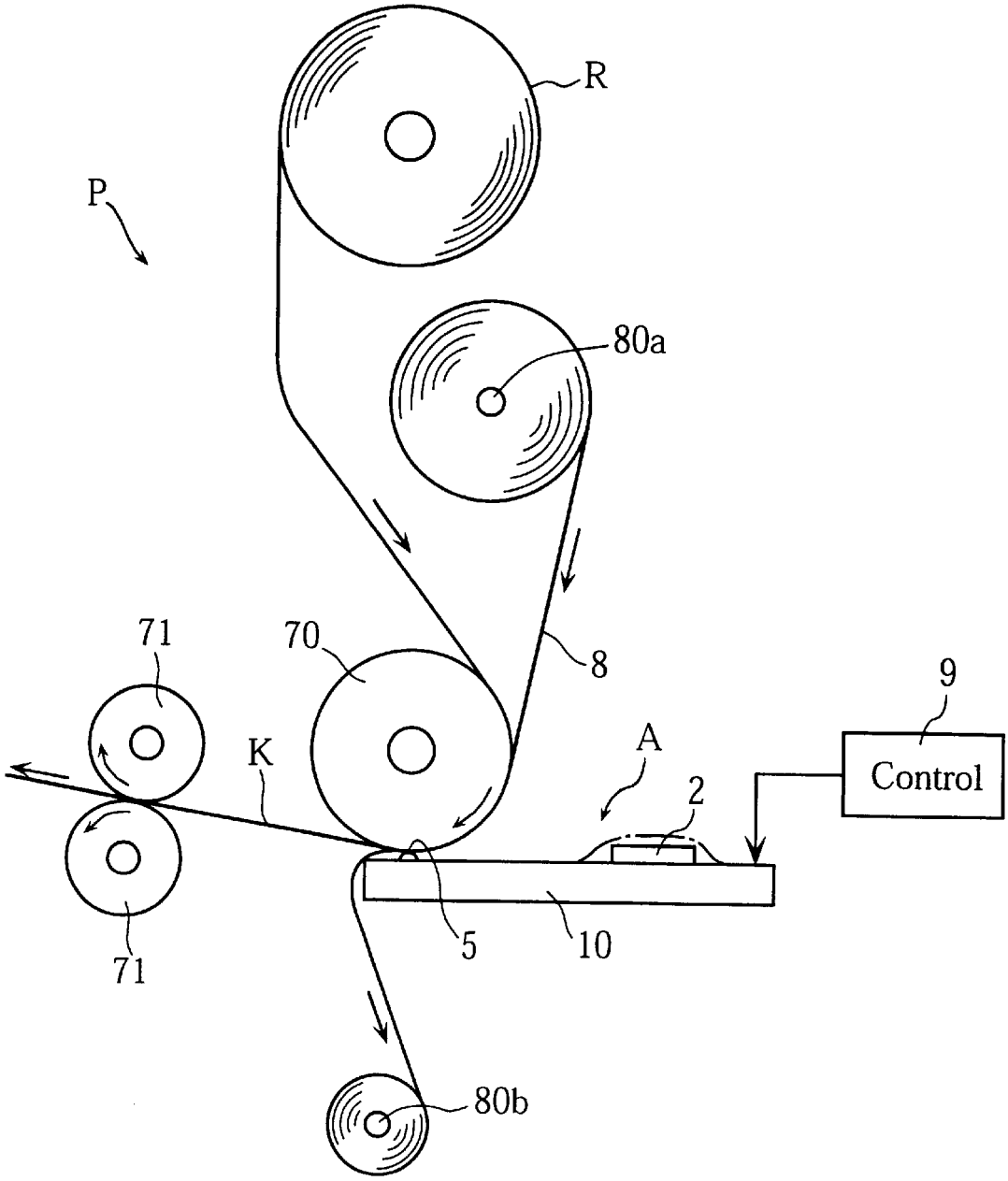
FIG. 1 is a schematic side view showing a thermal printer embodying the present invention.

As clearly shown in FIG. 1, a thermal printer P embodying the present invention comprises a thermal printhead A provided with a heating resistor 5, a platen roller 70 arranged in facing relationship to the heating resistor 5, a pair of transfer rollers 71 for transferring a recording paper K, a pair of shafts 80*a*, 80*b* for winding an ink ribbon 8, and a control circuit 9 for transmitting various signals and data to the thermal printhead A.

The recording paper K may be a rolled non-thermosensitive paper. The recording paper K paid out from a winding roll R passes between the platen roller 70 and the heating resistor 5 together with the ink ribbon 8 inserted under the paper K. The recording paper K is transferred to a paper discharge port (not shown) by the paired transfer rollers 71. The ink ribbon 8, which is of the thermosensitive type, is paid out from the shaft 80*a* for passage between the platen roller 70 and the heating resistor 5. The ink ribbon 8 is wound about the shaft 80*b*.

Figure 2:
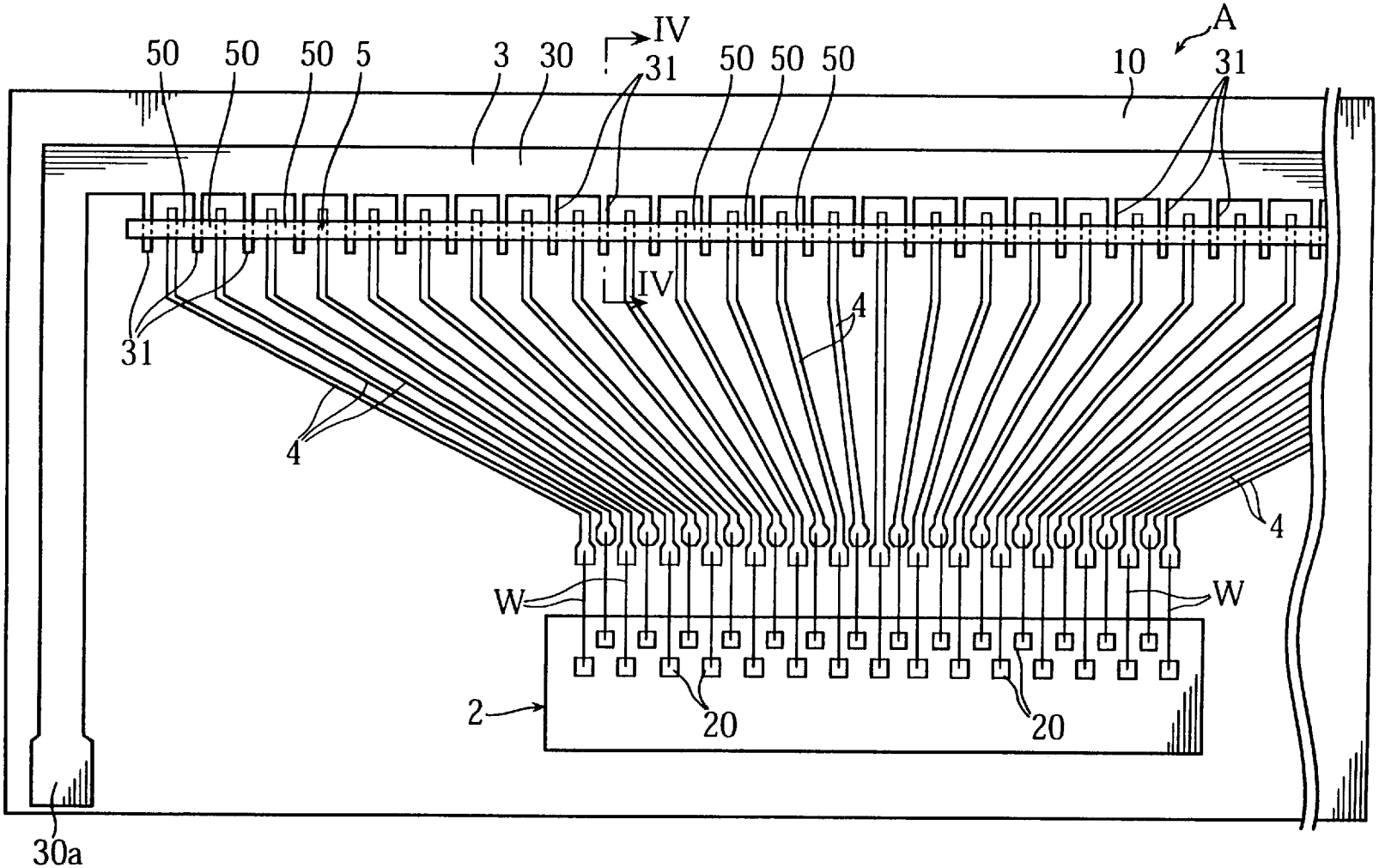
FIG. 2 is an enlarged plan view showing a thermal printhead incorporated in the thermal printer of FIG. 1.

As clearly shown in FIGS. 2 through 4, the thermal printhead A is a so-called thick-film thermal printhead which is identical in basic structure to a conventional thick-film thermal printhead except for the design of heating regions 50, as described later. Specifically, the thermal printhead A comprises a substrate 10 having an obverse surface formed with a glaze layer 11, a common electrode 3, a plurality of individual electrodes 4, and a protective layer 12 in addition to the heating resistor 5. The heating resistor 5 provides the plurality of heating regions 50. The substrate 10 is further provided with a plurality of drive IC chips 2 (only one shown in FIG. 2). For simplicity, the protective layer 12 is not shown in FIGS. 2 and 3.

The substrate 10 is made of an insulating material such as alumina ceramics and may have an elongated rectangular configuration.

The glaze layer 11, which is mainly composed of glass, functions as a heat retaining layer while also providing a smooth surface for forming the common electrode 3 and the individual electrodes 4.

The protective layer 12 protects the heating resistor 5, the common electrode 3 and the individual electrodes 4. The protective layer 12 may be formed by printing and baking a glass paste for example.

The common electrode 3 and the individual electrodes 4 may be made of a conductive film of copper for example. The common electrode 3 comprises a common line 30 connected at each end to a terminal 30*a* for applying a positive voltage, and a plurality of comb-teeth 31 extending from the common line 30 widthwise of the substrate 10. Each of the individual electrodes 4 has a first end extending into a space between two adjacent comb-teeth 31, and a second end opposite to the first end.

Each drive IC chip 2 incorporates a circuit for controlling the heating of the heating regions 50 in accordance with the printing data. The drive IC chip 2 is provided with a plurality of output electrodes 20 each of which is connected to the second end of a respective individual electrode 4 via a wire W. The drive IC chip 2 functions to selectively conduct a current through the individual electrodes 4.

The heating resistor 5 may be formed by printing and baking a thick film of a resistor paste containing, for example, ruthenium oxide as a conductive component. The heating resistor extends longitudinally of the substrate 10 over and across the comb-teeth 31 of the common electrode 3 and the first ends of the individual electrodes 4. A portion of the heating resistor 5 between each comb-tooth 31 and an adjacent individual electrode 4 serves as a unit heating region 50.

Figure 3:
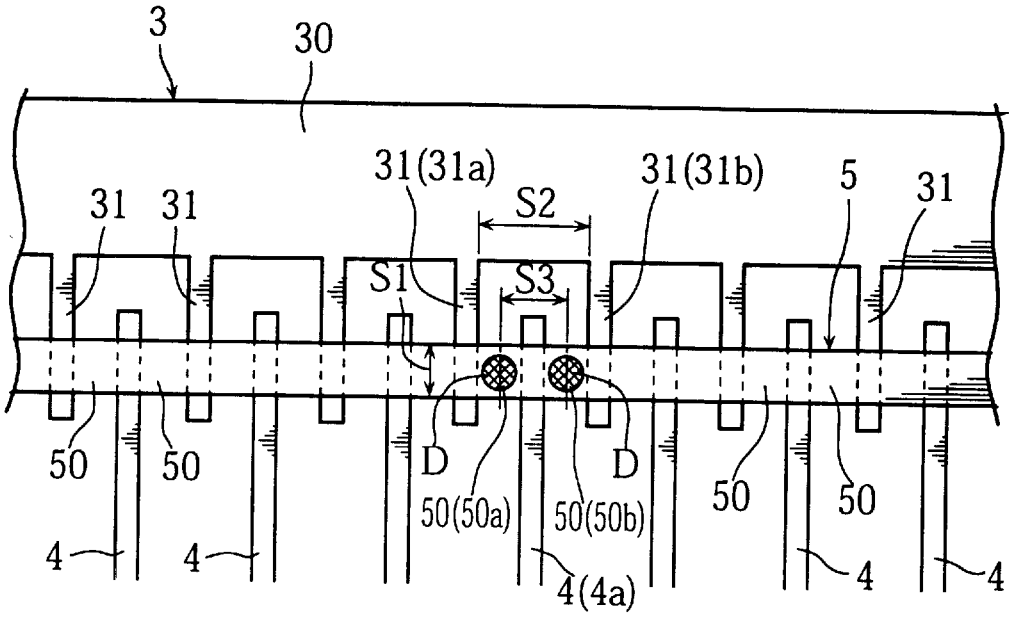
FIG. 3 is a further enlarged, fragmentary plan view showing a principal portion of the thermal printhead of FIG. 2.
Figure 4:
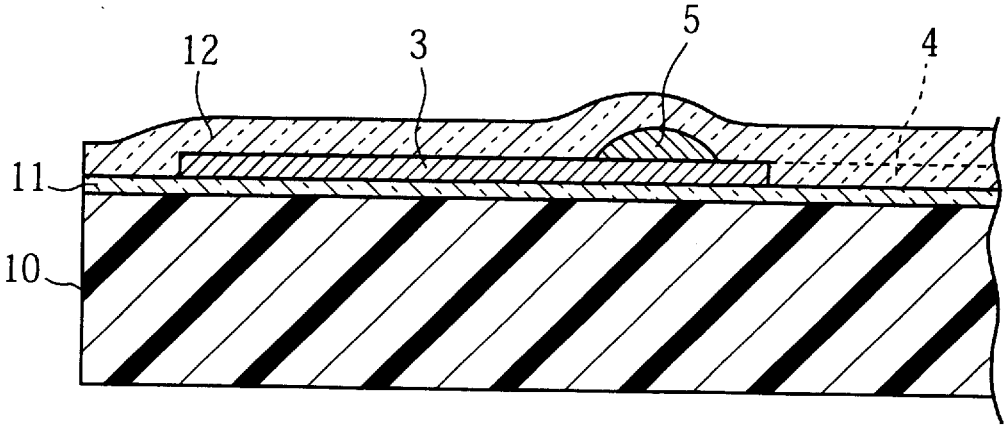
FIG. 4 is a sectional view taken along lines IV—IV in FIG. 2.

Referring to FIG. 3, when a current is applied to one individual electrode 4 (referred to as "active individual electrode), the current flows through two unit heating regions 50 (distinguished as "active unit heating regions 50*a*, 50*b*") located between an adjacent pair of comb-teeth 31 (distinguished as "active comb-teeth 31*a*, 31*b*") flanking the active individual electrode 4, so that the two active unit heating regions 50*a*, 50*b* are simultaneously heated. Each of the active unit heating regions 50*a*, 50*b* provides a generally circular heating dot D which is higher in temperature than other portions. The temperature of the heating dot D is the highest at the center thereof. The diameter of the heating dot D increases as the energy applied to the unit heating region 50 increases.

In the thermal printer P according to the illustrated embodiment, the energy applied to each unit heating region 50 can be gradated in several steps. Each unit heating region 50 has a width S1 in the second scanning direction which is, for example, one half of the total width S2 of two adjacent unit heating regions 50 in the primary scanning direction.

The control circuit 9 performs the error diffusion for the printing data which includes e.g. 256 gradations and then transmits the printing data to the drive IC chip 2. With the thermal printer P according to the illustrated embodiment, an image is printed on the recording paper K while transmitting the recording paper K in the second scanning direction. One pixel of the image consists of four print dots arranged in a matrix in the primary and secondary scanning directions. The matrix of dots is formed by two times of printing, first for printing two dots along a first line in the primary scanning direction and second for printing other two dots along a second line in the primary scanning direction. Such a printing operation is also controlled by the control circuit 9.

Specifically, the thermal printer P performs a printing operation in the following manner under the control of the control circuit 9.

The printing control provided by the control circuit 9 relies on error diffusion utilizing a multiplicity of values. As shown in FIGS. 5*a* through 5*i*, one pixel of an image can be represented by nine print output levels which include levels 0 through 8. In level 0, all the four print dots d are off-dots (white dots). In levels 1 through 4, the two dots d in the first line are on-dots, whereas the two dots d in the second line are off-dots. The diameter of each on-dot d in the first line gradually increases from level 1 to level 4. In levels 5 through 8, all the print dots d are on-dots. The diameter of each dot d in the second line gradually increases from level 5 to level 8 while the diameter of each dot d in the first line is kept maximum. In level 0 and level 8, all the four print dots are diametrically identical to each other.

The diameter of each print dot d corresponds to the diameter of the relevant heating dot D provided by the heating region 50. The diameter of the print dot d can be varied by varying the duration (width) of a pulse signal transmitted from the control circuit 9 to the IC chip 7 for selectively energizing the individual electrodes 4 (See FIG. 6). As the width of the pulse signal increases, the dot diameter increases.

The recording paper K is transferred in the secondary scanning direction so that the pitch p1 between the first line and the second line generally coincides with the distance S3 (See FIG. 3) between the centers of two adjacent heating regions 50 (forming a pair) which are heated simultaneously. As a result, the centers of the four print dots, which provide one pixel or unit matrix, are equally spaced from each other both in the primary scanning direction and in the secondary scanning direction. In the representation mode of level 8 shown in FIG. 5, therefore, the pixel becomes generally square, which is advantageous for properly representing an image and equalizes the printing resolution with respect to the primary scanning direction and the secondary scanning direction.

Further, as described with reference to FIG. 3, the width S1 of each heating region 50 in the secondary scanning direction is a half of the total width S2 of two adjacent heating regions 50 (forming a pair) in the primary scanning direction. This is also helpful for providing a pixel having a configuration close to square and for decreasing the size of the pixel while preventing the width of the pixel in the secondary scanning direction from excessively increasing.

Figure 6:
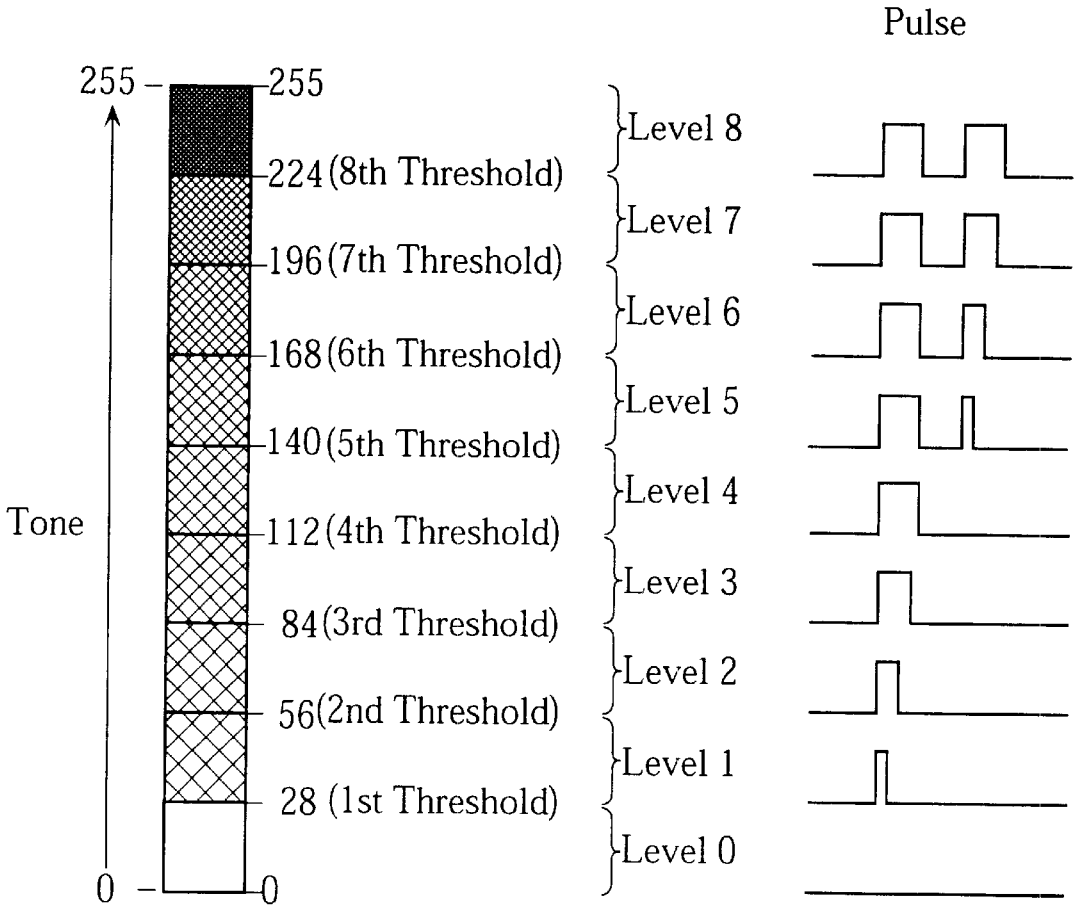
FIG. 6 illustrates examples of threshold values utilized for determining the print output levels.

In the illustrated embodiment, the nine output levels may be determined by utilizing eight threshold values. Specifically, as shown in FIG. 6, when the printing data includes 256 tones increasing from 0 (for white) through 255 (for black), eight threshold values may be selected in advance by dividing 256 by 9. Thus, a first threshold value for distinguishing levels 0 and 1 maybe set to 28 for example, whereas a second threshold value for differentiating levels 1 and 2 may be set to 56. Of course, other threshold values may be selected depending on the total number of tones or gradations.

The control circuit 9 perform multi-value error diffusion in the following manner.

Figures 5A, 5B, 5C, 5D, 5E, 5F, 5G, 5H, 5I:
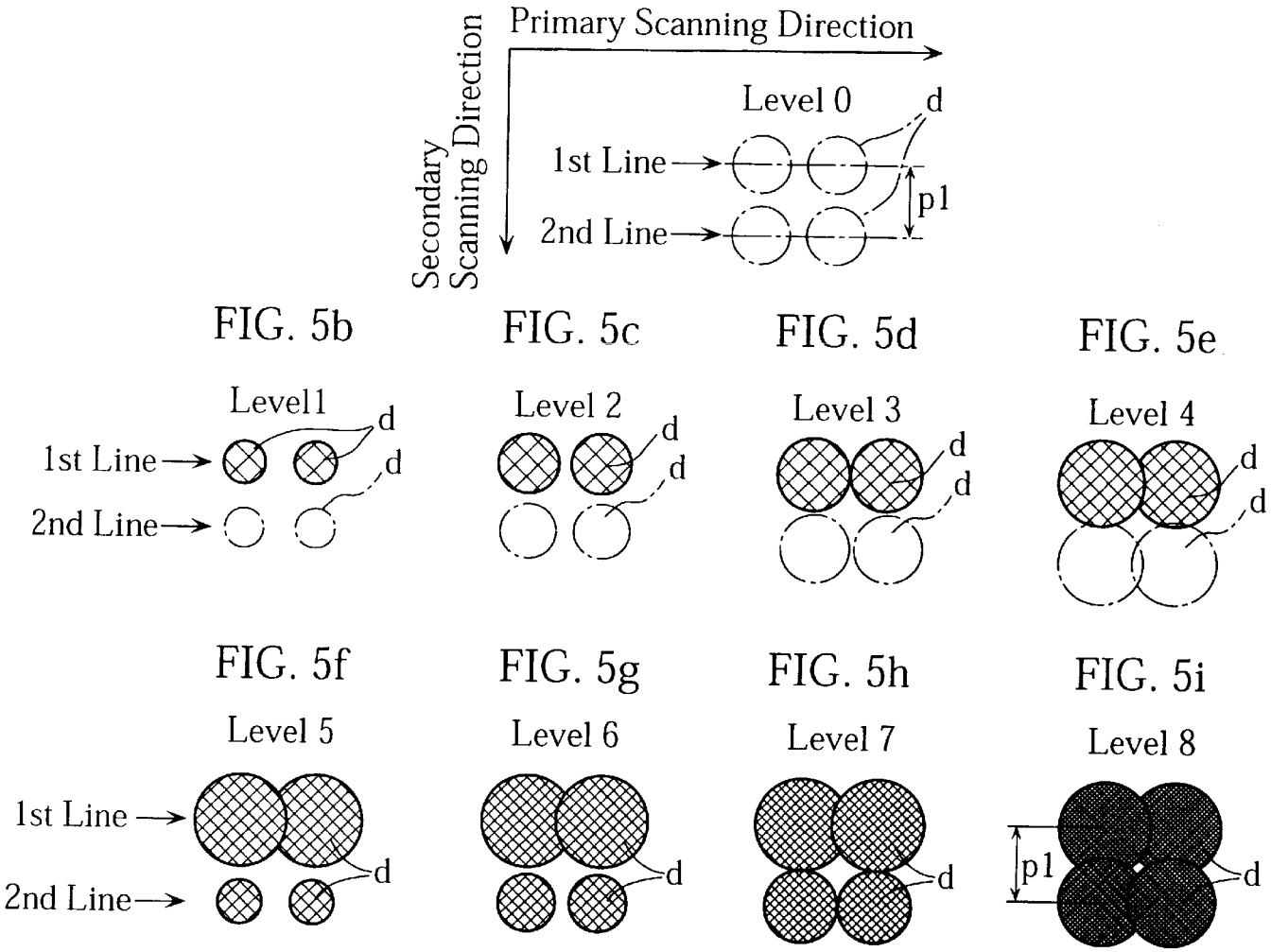
FIGS. 5*a*–5*i* illustrate various dot-formation modes corresponding to a plurality of print output levels.

It is now assumed that the tone of a first pixel of the printing data under control is 20 for example. In this case, the print output level for that pixel is determined as level 0 because 20 is lower than the first threshold value of 28. Therefore, the first pixel is printed on the recording paper K as a white pixel (FIG. 5*a*).

Figure 7:
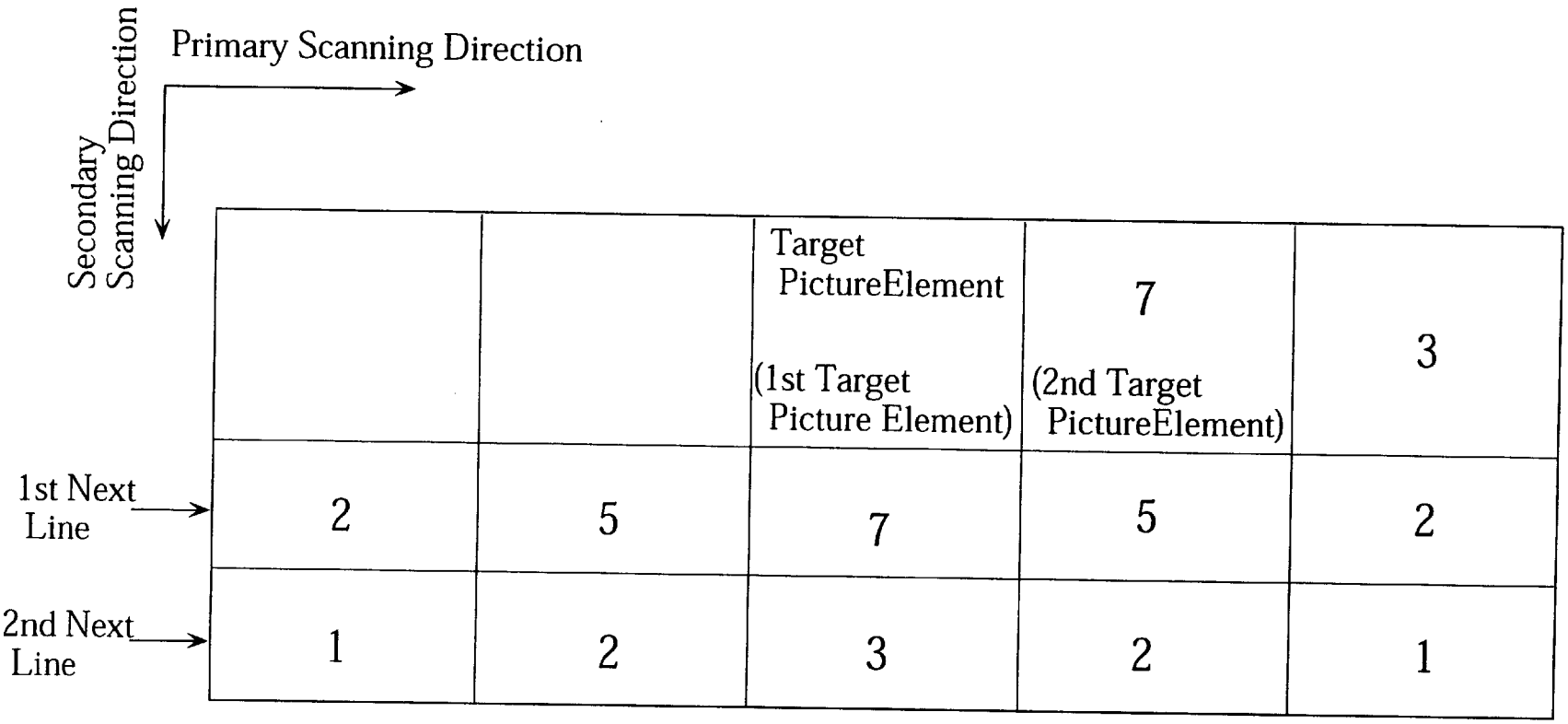
FIG. 7 illustrates an example of error diffusion processing.

Although the tone of the first pixel is actually 20, the first pixel is recorded on the recording paper K as a white pixel of tone 0. Therefore, the recorded first pixel is brighter than the actual tone by 20, thereby resulting in an error between the actual pixel tone and the printed pixel tone. Then, the error amount of 20 needs to be allocated or diffused to a plurality of nearby pixels each toward a darker side for a predetermined proportion. Specifically, as shown in FIG. 7, the error may be diffused to e.g. ten pixels located close to the first pixel and arranged in three successive lines including the same line as the first pixel. The proportion of error diffusion is exemplarily shown in FIG. 7. Since the total of values 7, 3, 2, 5, 7, 5, 2, 1, 2, 3, 2, 1 in this figure is 40, the tone of a second pixel located next to the first pixel is increased by 7/40 of the error amount (20), yielding an increase of 3.5.

Assuming that the actual tone of the printing data for the second pixel is initially 26, the tone value is adjusted to 29.5 by adding 3.5 to 26. Since the tone of the second pixel thus obtained exceeds the first threshold value of 28, the print output level for the second pixel is determined as level 1. Therefore, the second pixel is printed on the recording paper K in the representation mode shown in FIG. 5*b*.

The tone of level 1 corresponds to the tone 28 of the first threshold value. Therefore, the second pixel printed on the recording paper K is actually brighter than the intended tone by the error amount of 1.5 (29.5 minus 28). This error amount needs to be diffused to a plurality of nearby pixels in the same manner as described above.

In this way, in determining the print output level of each pixel, the tone error of a pixel is diffused to subsequent pixels at predetermined proportions. As a result, the tone error becomes negligible when a plurality of pixels in a certain area are totally viewed.

According to the present embodiment, the tone of an image can be represented in nine gradations (FIGS. 5*a*–5*i*) on a pixel-by-pixel basis, which is the printing resolution on a pixel-by-pixel basis. With this method, half tone can be represented more minutely than with the printing method utilizing two-value error diffusion. Therefore, it is unnecessary to considerably increase the number of the heating regions 50 in the primary scanning direction in obtaining a high-quality image which has a relatively high resolution with a well-represented half tone. If the number of the heating regions 50 in the primary scanning direction is increased, there is a need for a larger number of IC chips a complicated electric circuit therefor, which leads to an increase in the manufacturing cost of a thermal printer. The present embodiment can avoid such a disadvantage and makes it possible to provide a high quality image with the use of an inexpensive thermal printhead.

The present invention is not limited to the above-described embodiment. Various modifications may be made with respect to each component of the thermal printer and each process step of the printing operation.

For example, instead of representing one pixel in nine output levels (gradations), one pixel may be in three output levels for performing three-value error diffusion. Also in this case, it is possible to obtain a higher quality print image than is obtainable by the conventional method utilizing two-value error diffusion.

Further, one pixel need not necessarily consist of four print dots. Instead, one pixel may consist of two, six or other number of print dots.

Although the monochromatic image printing is described in the above embodiment, the present invention is also applicable to the color image printing. In performing the color image printing by combining print dots of three colors (i.e. cyan, magenta and yellow), the print dots are recorded on a recording paper in a manner similar to the monochromatic printing. Further, according to the present invention, an image may be directly printed on a thermosensitive paper without using an ink ribbon.

The thermal printhead embodying the present invention need not be used exclusively for printing only but may have an additional function of image-reading for example.

What is claimed is:

1. A thermal printer comprising:

a thermal printhead including an array of heating regions extending in a primary scanning direction, and a driver for selectively heating the heating regions;

a transfer assembly for feeding a recording paper in facing relationship to the row of heating regions of the printhead in a secondary scanning direction perpendicular to the primary scanning direction; and a controller combined with the driver for causing each of the heating regions to selectively form, on the recording paper, differently sized print dots which include an off-dot, a maximum-size dot, and at least one intermediate-size dot;

wherein the controller combined with the driver controls printing on a pixel-by-pixel basis, each pixel comprising a matrix of print dots which includes at least two rows of print dots located adjacent to each other in the secondary scanning direction, each row of print dots including two print dots located adjacent to each other in the primary scanning direction.

2. The thermal printer according to claim 1, wherein the controller combined with the driver causes each of the heating regions to selectively form different intermediate-size print dots in addition to the off-dot and the maximum-size dot.

3. The thermal printer according to claim 2, wherein the recording paper is transferred in the secondary scanning direction by a pitch which is generally equal to a center-to-center distance between the two print dots in each row of the matrix.

4. The thermal printer according to claim 2, wherein the controller combined with the driver causes each of the heating regions to selectively form the different intermediate-size print dots and the maximum-size print dot by selectively supplying pulses of different widths to each of the heating regions.

5. The thermal printer according to claim 1, wherein the controller combined with the driver is capable of printing each pixel in different output levels which include a lowest output level wherein all print dots in the matrix are the off-dots, a highest output level wherein all print dots in the matrix are the maximum-size dots, and at least one intermediate output level wherein the two dots in one row of the matrix are intermediate-size dots which are equally sized.

6. The thermal printer according to claim 1, wherein the controller combined with the driver is capable of printing each pixel in different output levels which include a lowest output level wherein all print dots in the matrix are the off-dots, a highest output level wherein all print dots in the matrix are the maximum-size dots, a first intermediate output level wherein the two dots in one row of the matrix are intermediate-size dots which are equally sized, and a second intermediate output level wherein the two dots in one row of the matrix are the maximum-size dots while the two print dots in another row of the matrix are intermediate-size dots which are equally sized.

7. The thermal printer according to claim 1, wherein each of the heating regions has a width in the secondary scanning direction which is smaller than a total width of two adjacent heating regions in the primary scanning direction.

8. The thermal printer according to claim 1, further comprising a thermal transfer ink ribbon fed between the printhead and the recording paper.

* * * * *